US007871173B2

(12) United States Patent
Lin et al.

(10) Patent No.: US 7,871,173 B2
(45) Date of Patent: Jan. 18, 2011

(54) MULTI-COLORED LIGHTING DEVICE

(75) Inventors: Yan X. Lin, Guangdong (CN); Yao Z. Tan, Guangdong (CN); Thomas M. Spain, Elmhurst, IL (US)

(73) Assignee: Lava Lite, LLC, Chicago, IL (US)

( * ) Notice: Subject to any disclaimer, the term of this patent is extended or adjusted under 35 U.S.C. 154(b) by 271 days.

(21) Appl. No.: 12/017,950

(22) Filed: Jan. 22, 2008

(65) Prior Publication Data

US 2008/0174988 A1 Jul. 24, 2008

Related U.S. Application Data

(60) Provisional application No. 60/886,077, filed on Jan. 22, 2007.

(51) Int. Cl.
*F21V 33/00* (2006.01)

(52) U.S. Cl. ..... 362/101; 362/293; 362/318; 362/355; 362/806; 362/811; 40/406; 40/409

(58) Field of Classification Search ..... 362/101, 362/293, 318, 351–361, 806, 811; 40/406, 40/409

See application file for complete search history.

(56) References Cited

U.S. PATENT DOCUMENTS 3,387,396 A * 6/1968 Smith ..... 40/406
4,268,896 A * 5/1981 Mann ..... 362/360
6,398,390 B1 * 6/2002 Schacht ..... 362/356

* cited by examiner

*Primary Examiner*—Stephen F Husar
(74) *Attorney, Agent, or Firm*—Knechtel, Demeur & Samla

(57) ABSTRACT

A lighting device. The lighting device includes a base portion, a diffuser portion having a wall defining an inner cavity, wherein the wall includes a plurality of colors, the plurality of colors defining a color pattern, and a light source for illuminating the diffuser portion.

19 Claims, 8 Drawing Sheets

MULTI-COLORED LIGHTING DEVICE

CROSS REFERENCE TO RELATED APPLICATIONS

This application claims the benefit of prior filed U.S. Provisional Application No. 60/886,077, filed on Jan. 22, 2007, the entire contents of which are incorporated by reference.

BACKGROUND

The present invention relates to a lighting device, and more particularly to a novelty or decorative lighting device.

Novelty or decorative lighting devices provide the visual effects of changing light patterns by passing light through liquids or other materials contained within transparent housings located between a viewer and a source of light. In addition to illuminating the liquid, a light source may also provide heat to the liquid and other materials contained within the transparent housings. The liquid and other materials contained within the transparent housings may appear to be in motion, thereby creating further visual effects for the viewer.

SUMMARY

In one embodiment, the invention provides a lighting device. The lighting device includes a base portion, a diffuser portion having a wall defining an inner cavity, wherein the wall includes a plurality of colors, the plurality of colors defining a color pattern, and a light source for illuminating the diffuser portion.

In another embodiment the invention provides a decorative lamp. The decorative lamp includes a base portion, a diffuser portion having a wall defining an inner cavity, wherein a liquid is contained within the inner cavity of the diffuser portion, and a light source supported by the base portion for illuminating the diffuser portion. The wall includes a plurality of colors, the plurality of colors defining a color pattern configured to create a color-changing effect.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
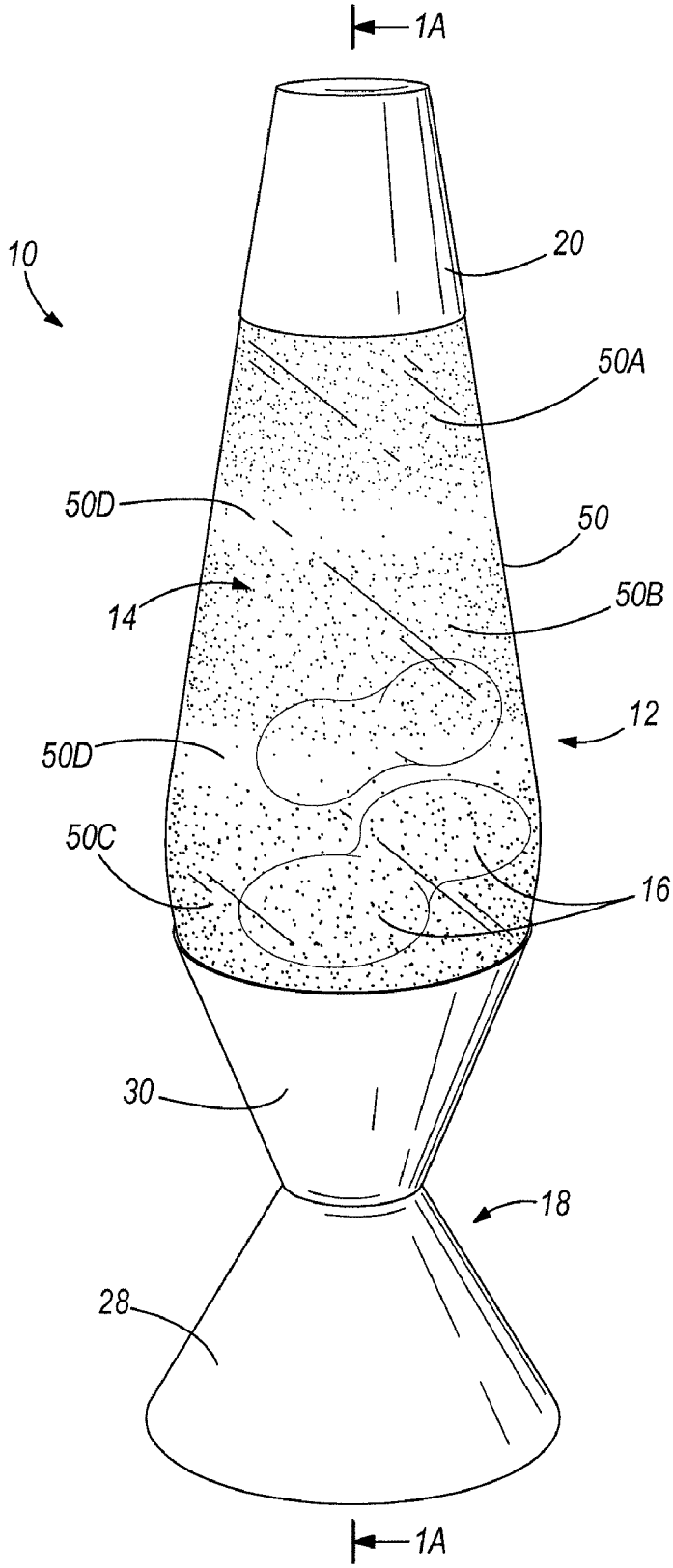
FIG. 1 illustrates a multi-colored lighting device according to one embodiment of the invention.

FIG. 1 illustrates a multi-colored lighting device 10 according to one embodiment of the invention. The lighting device 10 provides an illuminated display that presents a visual effect of changing colors in changing patterns of shapes when viewed by an observer. The lighting device 10 is a motion lamp including a diffuser portion 12 visually displaying at least two colors therein. Liquid 14 and oozing blobs, goo or liquid globules 16 are housed within the diffuser portion 12. As the oozing blobs, goo or liquid globules 16 rise and fall within the diffuser portion 12, it appears as if the liquid 14 and oozing blobs, goo or liquid globules 16 are changing in colors.

The lighting device 10 includes a base portion 18, the diffuser portion 12, and a tip or cap 20. In one embodiment, the lighting device 10 includes a rotating ON/OFF switch 22 connected to a power cord 24 (FIG. 5); however, the lighting device 10 may include any other suitable controller, such as an ON/OFF switch located on one of the sides or on the bottom the base portion.

Figure 1A:
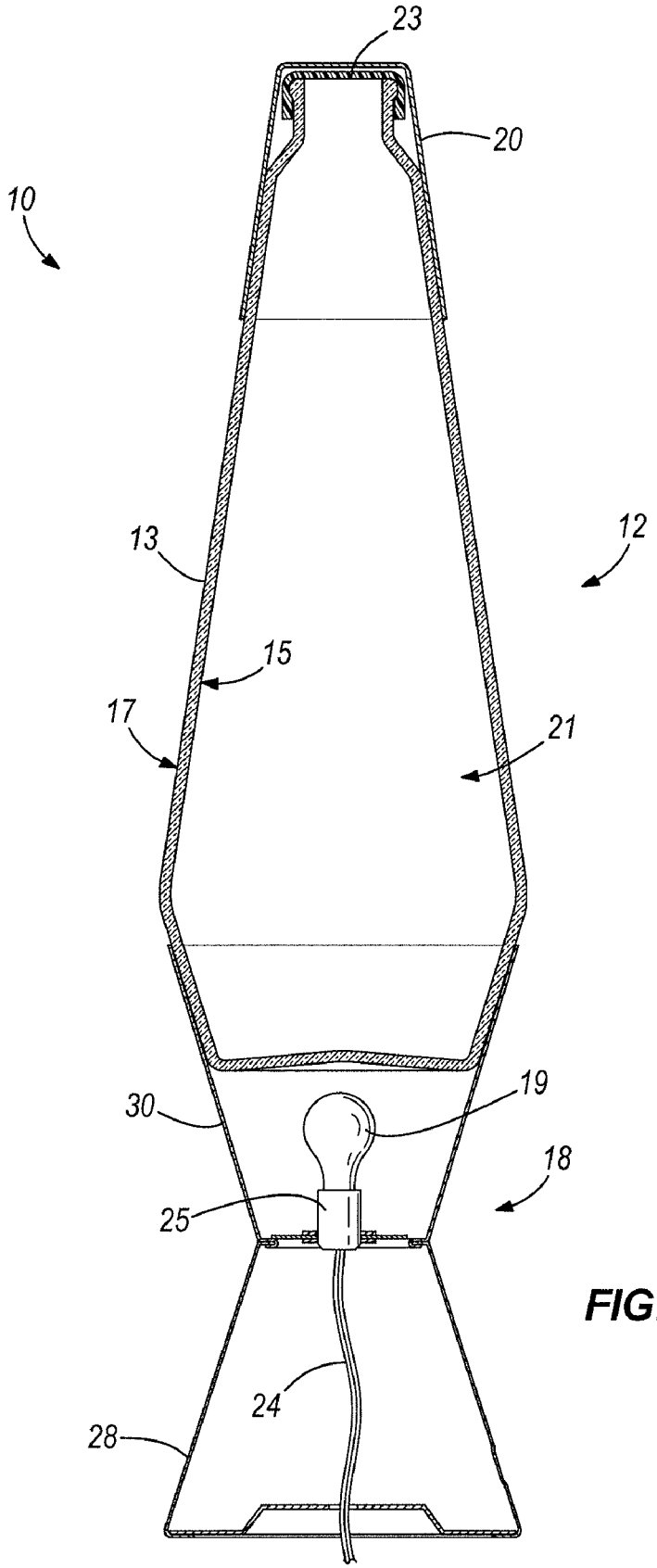
FIG. 1A illustrates a sectional view of the lighting device shown in FIG. 1 taken along line 1A-1A.
Figure 2:
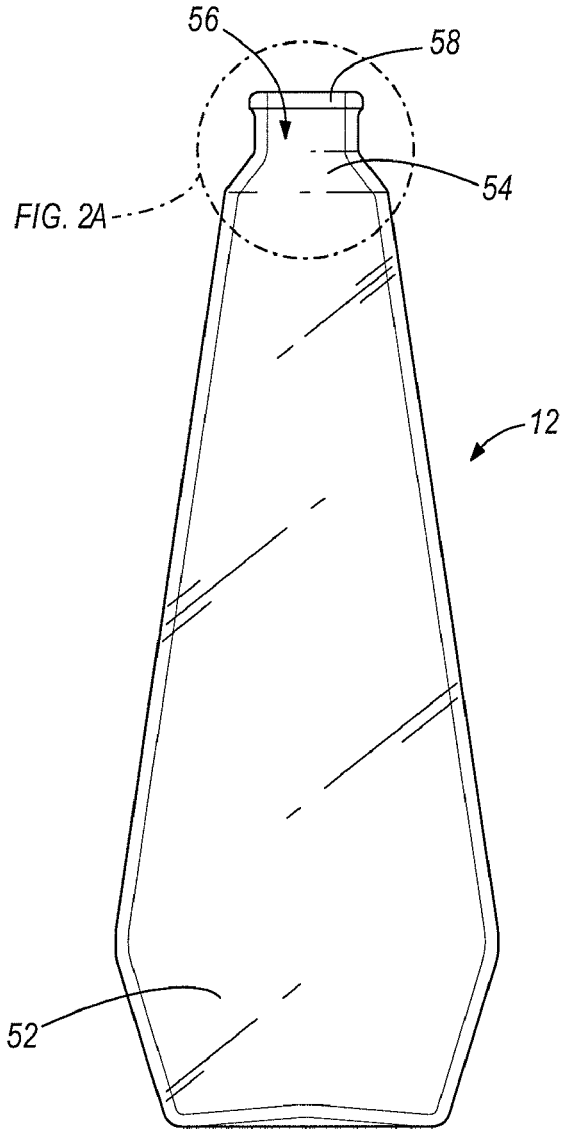
FIG. 2 illustrates a diffuser portion of the lighting device shown in FIG. 1.
Figure 3:
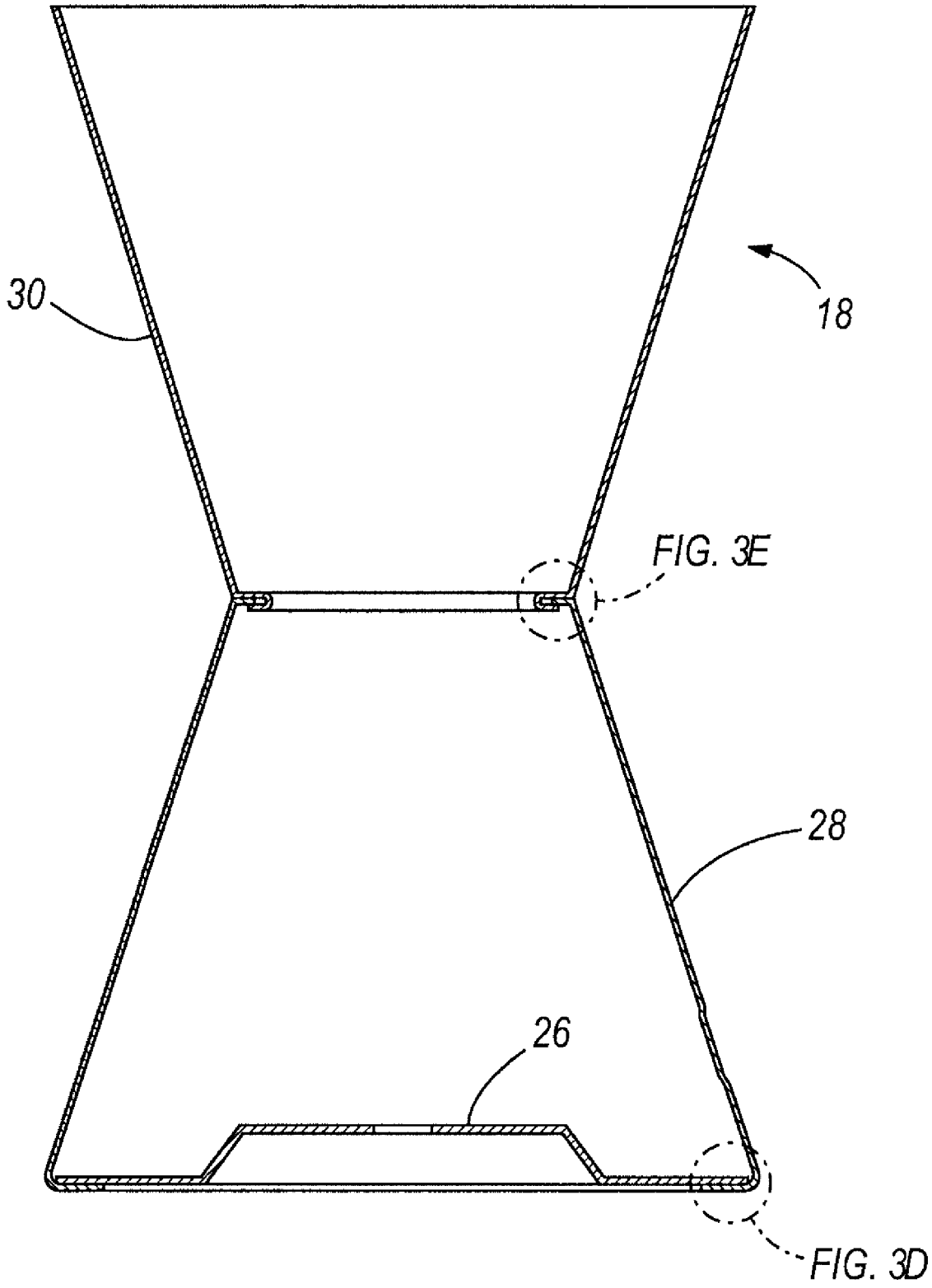
FIG. 3 illustrates a base portion of the lighting device shown in FIG. 1, and FIGS. 3A, 3B and 3C illustrate a bottom plate of the base portion and first and second support members, respectively.
Figure 3A:
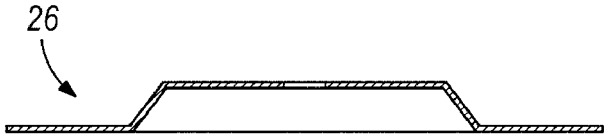
FIGS. 3D and 3E illustrate a bottom cone crimp and a top cone crimp, respectively.
Figure 3B:
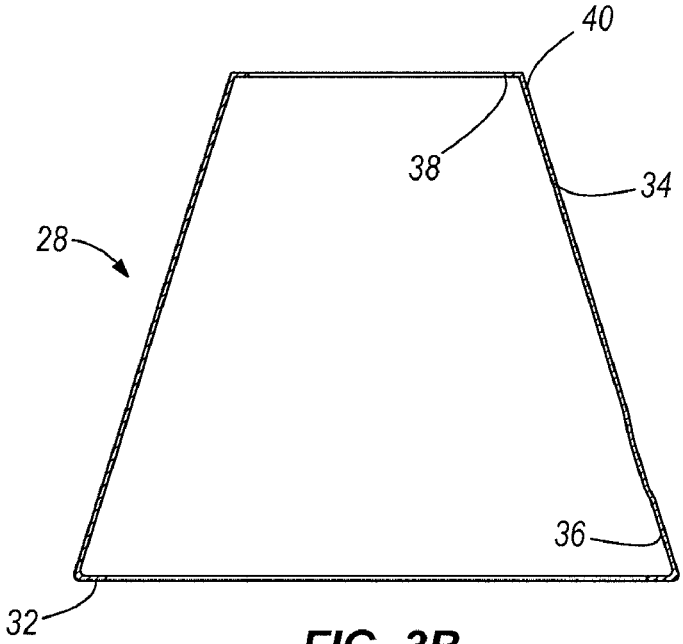
Figure 3C:
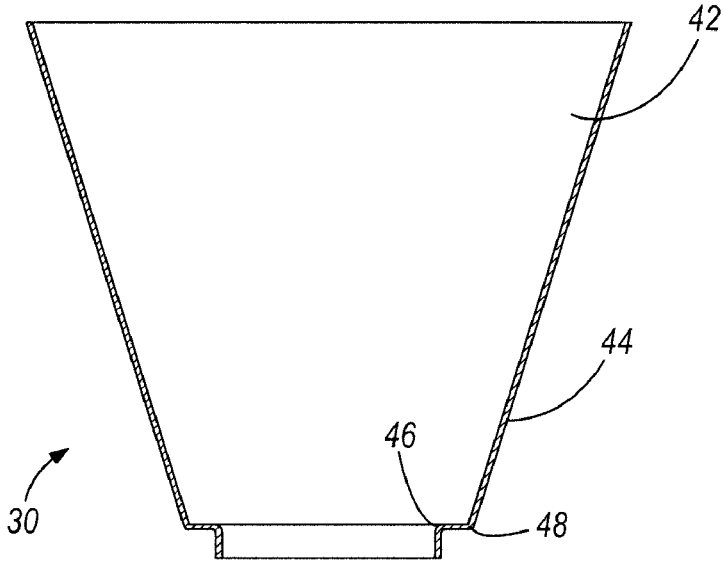

Referring to FIGS. 1A, 2 and 3, the base portion 18 includes a bottom plate 26 (FIG. 3A), a first support member 28 (FIG. 3B), and a second support member 30 (FIG. 3C), and a light source 19. In one embodiment, a light bulb socket 25 is connected to the power cord 24 and includes suitable electrical contacts for providing power to a light bulb. In some embodiments, the base portion 18 houses one or more batteries to provide power to a light source. For example, the base portion 18 may include a rechargeable battery pack or any other suitable rechargeable power supply to provide power to the light source. The base portion 18 may include any suitable light sources, which may or may not emit heat (e.g., light bulbs, white or colored LEDs; incandescent bulbs; fluorescent bulbs; halogen bulbs; decorative bulbs; General Electric REVEAL® bulbs; high-intensity discharge bulbs).

Figure 3E:
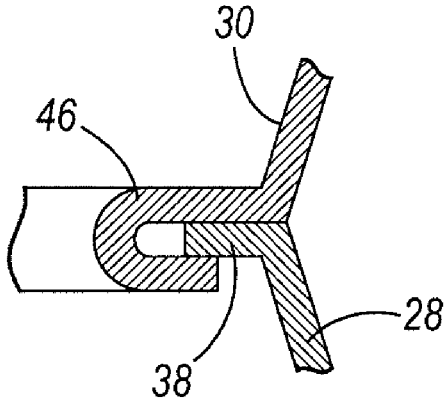
Figure 3D:
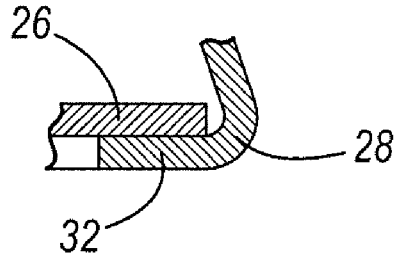

As shown in FIG. 3, the bottom plate 26 of the base portion 18 has a shape suitable for mating with the first support member 28. A lower edge 32 of the first support member 28 wraps around the bottom plate 26 to couple the two together (FIG. 3D). In further embodiments, the bottom plate 26 may be coupled to the first support member 28 with fasteners, or the first support member 28 includes an integral bottom plate rather than a separate bottom plate 26.

In the illustrated embodiment, the first support member 28 has a generally frusto-conical shape and includes an upper portion 34 and a lower portion 36. The first support member 28 tapers from the lower portion 36 to the upper portion 34. The upper portion 34 includes a lip 38 (FIGS. 3B and 3E) that extends radially inward from an upper edge 40 of the first support member 28.

In the illustrated embodiment, the second support member 30 has a generally frusto-conical shape and includes an upper portion 42 and a lower portion 44. The second support member 30 tapers from the upper portion 42 to the lower portion 44. The lower portion 44 includes a flange 46 that extends radially inward from a lower edge 48 of the second support member 30. To assemble the base portion 18, the lower (i.e., smaller) portion 44 of the second support member 30 is coupled to the upper (i.e., smaller) portion 34 of the first support member 28. The flange 46 of the second support member 38 is swaged around the lip 38 of the first support member 28 and then spot-welded or crimped thereto (FIG. 3E). It should be readily apparent to those of skill in the art that in further embodiments the first and second support members 28, 30 may be coupled together in other known manners, such as by fasteners, or with the first support member 28 swaged around a lip of the second support member 30. In a further embodiment, the first support member 28 and the second support member 30 are integrally formed as a single piece.

When assembled, the base portion 18 has a generally-round hourglass shape. In other embodiments, the base portion 18 has a squared-off hourglass shape (as will be described with respect to FIG. 5) or a combination of round and square portions. The base portion 18 is comprised of aluminum. In other embodiments, the base portion 18 may be comprised of materials including, but not limited to, steel, plastic, or like material. The base portion 18 has a chromed finish. In other embodiments, the base portion 18 may comprise a painted finish, a brushed finish, or other custom finish.

Referring to FIGS. 1, 1A and 2, the diffuser portion 12 includes a globe or container that holds liquid 14 and oozing blobs, goo or liquid globules 16 (e.g., those diffuser portions used in LAVA® brand motion lamps). In an embodiment in which the diffuser portion 12 holds liquid 14 and oozing blobs, goo, or liquid globules 16, the diffuser portion 12 is constructed of a fully-transparent or translucent and waterproof material or wall 13, such as glass. The wall 13 has an interior surface 15 and an exterior surface 17. The wall 13 defines a cavity 21 that holds the liquid 14 and oozing blobs, goo, or liquid globules 16. In some embodiments, the diffuser portion 12 holds up to thirty-two ounces of liquid and/or material. In further embodiments, the diffuser portion 12 is constructed of a non-waterproof, transparent or frosted plastic, such as acrylic or propylene.

The wall 13 of the diffuser portion 12 has at least two of a plurality of colors applied on either or both of the interior surface 15 and the exterior surface 17. The colors are applied to the wall 13 of the diffuser portion 12 to create a color-changing effect. The combination of colors creates a color pattern 50. The color pattern 50 may be translucent, transparent, or sufficient to allow light to pass through the diffuser portion 12. Further, the color pattern 50 includes at least two colors. For example, the diffuser portion 12 shown in FIG. 1 includes a multi-colored pattern, including a red area 50A (represented in FIG. 1 with small stipple-style shading), a blue area 50B (represented in FIG. 1 with medium stipple-style shading), a green area 50C (represented in FIG. 1 with large stipple-style shading), and intermediate color areas 50D between the areas. The intermediate color areas 50D are the sections of the diffuser portion 12 having a blending of the colors adjacent the intermediate area. For example, an intermediate color area may be green where the color areas adjacent the intermediate area are yellow and blue. Alternatively, the intermediate area may include lighter shades of color as compared to the adjacent color areas. For example, an intermediate area adjacent a blue area may include various shades of blue that are lighter than the blue color area. Furthermore, it should be readily apparent to those of skill in the art that in further embodiments, the colors and color patterns may include any combination of colors, including but not limited to, red, yellow, orange, green, blue, purple, and any other color.

The color pattern 50 may be applied in various ways, including, but not limited to, painting, spraying, silk screening, or applying a colored film to the diffuser portion 12 to form each color area or multiple color areas. In a further embodiment, a graphic may be incorporated in the color pattern 50.

Figure 2A:
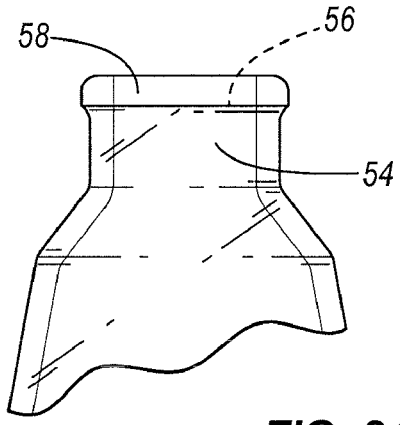
FIG. 2A is an enlarged view of a top portion of the diffuser portion.
Figure 4:
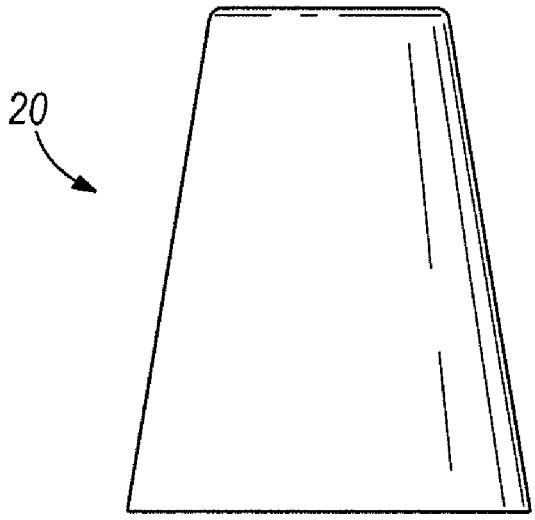
FIG. 4 illustrates a cap portion of the lighting device shown in FIG. 1.

The diffuser portion 12 has a shape of a typical LAVA® brand motion lamp. A lower portion 52 of the diffuser portion 12 is received the upper portion 42 of the second support member 28 and is supported by the upper portion 42. An upper portion 54 of the diffuser portion 12 (FIG. 2A) has a generally-circular opening 56 over which the tip or cap 20 is positioned. The cap 20 has a generally frusto-conical shape (FIG. 4). The cap 20 is supported by an upper edge 58 of the diffuser portion 12. The diffuser portion 12 includes a liquid-tight seal 23 positioned over or inside the circular opening 56 and beneath the cap 20.

In operation, a user places the lighting device 10 on a mounting surface, such as a table or desk top (not shown). The user turns the light source on, for example, by rotating the ON/OFF switch 22. Heat generated by the light source causes the oozing blobs, goo or liquid globules 16 to rise and fall within the liquid 14. The oozing blobs, goo or liquid globules 16 create a visual effect of changing colors in changing patterns of shapes as the oozing blobs, goo or liquid globules 16 rise and fall within the diffuser portion 12. This creates a visual effect that the liquid 14 and the oozing blobs, goo or liquid globules 16 are changing colors, when in actuality the diffuser portion 12 includes the color pattern 50.

When assembled, the lighting device 10 (i.e., the base portion 18, the diffuser portion 12, and the tip or cap 20) has the shape of a typical LAVA® brand motion lamp. In further embodiments, the lighting device 10 can be shaped in any other suitable manner. In some embodiments, the cap 20 is omitted or is integral with the diffuser portion 12. In addition, the base portion 18 and the diffuser portion 12 have the same shape as one another or different shapes. For example, the base portion 18 and the diffuser portion 12 may include various holiday, novelty, or decorative shapes. The base portion 18 may be cylindrical or rectangular (or any other suitable shape) and the diffuser portion 12 (or a combination of the base portion and the diffuser portion) may include, for example, a Christmas tree, a star, a Santa figure, an Easter egg, an Easter basket, a pumpkin, a ghost, a witch, a heart, a moon, a sun, a poker die, a globe, an American flag, various animal shapes, or any other novelty or decorative shape or shapes. In addition, the lighting device 10 may be constructed so that the base portion 18 is integral with the diffuser portion 12, i.e., there is no visible boundary between the base portion 18 and the diffuser portion 12. In each of these alternative configurations, the multi-colored patterned diffuser portion 12 may be used.

Figure 5:
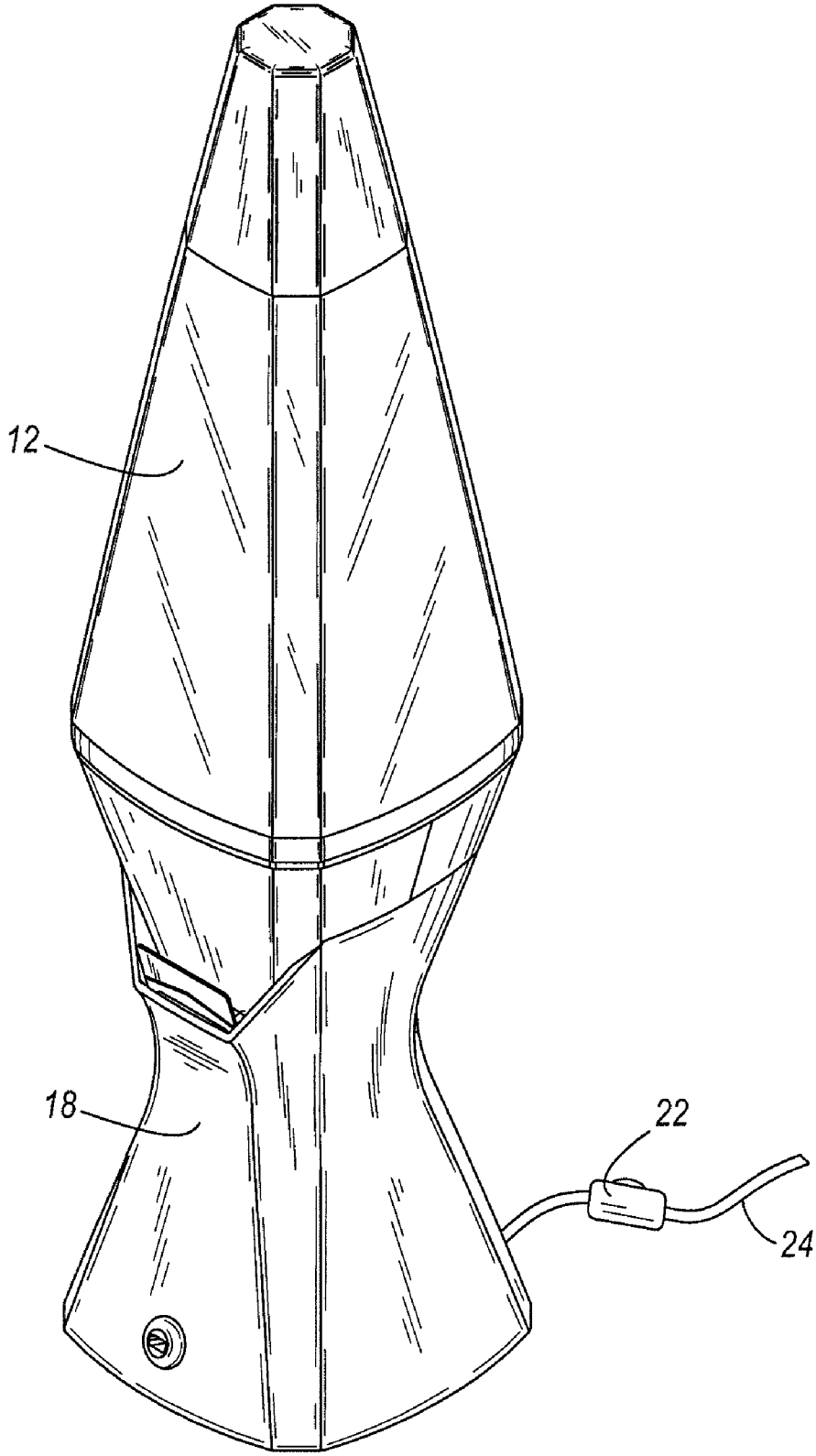
FIG. 5 is a perspective view of a lighting device having a squared-off configuration according to another embodiment of the invention.
Figure 7:
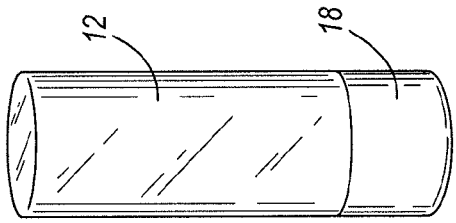
FIG. 7 is a perspective view of a lighting device in the shape of a cylinder according to another embodiment of the invention.
Figure 10:
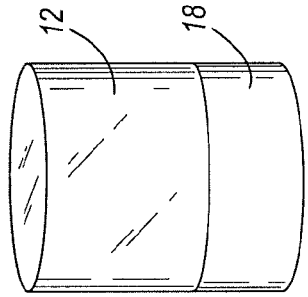
FIG. 10 is a perspective view of a lighting device having a canoe shape according to another embodiment of the invention.
Figure 6:
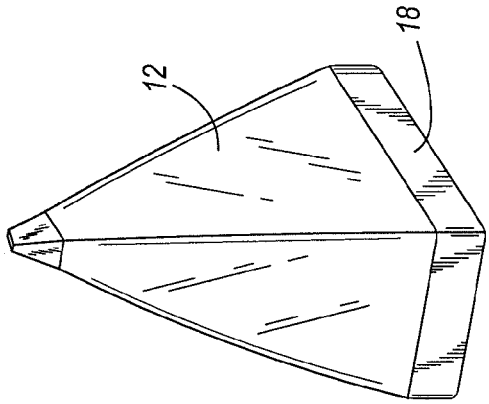
FIG. 6 is a perspective view of a lighting device in the shape of a pyramid according to another embodiment of the invention.
Figure 9:
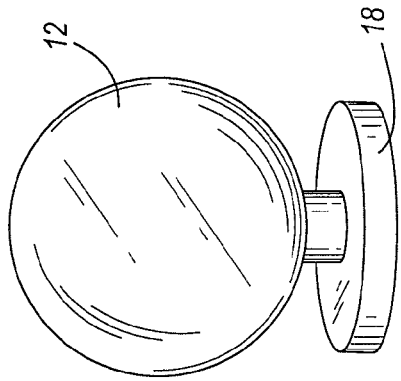
FIG. 9 is a perspective view of a lighting device in the shape of a sphere according to another embodiment of the invention.
Figure 8:
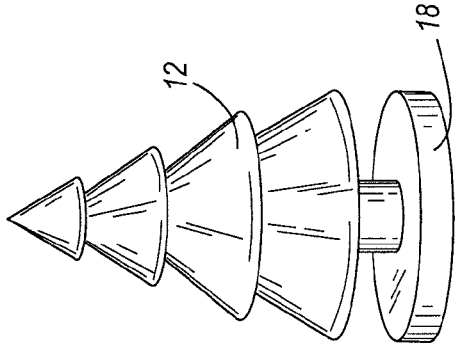
FIG. 8 is a perspective view of a lighting device in the shape of a Christmas tree according to another embodiment of the invention.

FIG. 5 illustrates a lighting device having a squared-off hourglass shaped base portion 18 with a pyramid-shaped, color patterned diffuser portion 12. FIG. 6 illustrates a lighting device having a rectangular base portion 18 with a pyramid-shaped, color patterned diffuser portion 12. FIG. 7 illustrates a lighting device having a cylindrical base portion 18 with a cylindrical, color patterned diffuser portion 12. FIG. 8 illustrates a lighting device having a cylindrical base portion 18 with a Christmas tree-shaped, color patterned diffuser portion 12. FIG. 9 illustrates a lighting device having a cylindrical base portion 18 with a sphere-shaped, color patterned diffuser portion 12. FIG. 10 illustrates a lighting device having a canoe-shaped base portion 18 with a canoe-shaped, color patterned diffuser portion 12. It should be readily apparent to those of skill in the art that in further embodiments, the lighting device 10 can be shaped in any other suitable manner beyond those shown in FIGS. 1 and 5-10.

It is to be understood that the invention is not limited in its application to the details of the construction and the arrangements of the components set forth in the above description or illustrated in the drawings. The invention is capable of other embodiments and of being practiced or carried out in various ways which are still within the spirit and scope of the present invention. Also, it is understood that the phraseology and terminology used herein is for the purpose of description and should not be regarded as limiting. Various features and advantages of the invention are set forth in the following claims.

What is claimed is:

1. A lighting device comprising:

a base portion;

a diffuser portion having a wall defining an inner cavity, a liquid contained within the inner cavity of the diffuser portion, wherein the wall includes a plurality of colors, the plurality of colors defining a color pattern; and a light source supported by the base portion for illuminating the diffuser portion.

2. The lighting device of claim 1, wherein the liquid includes liquid globules.

3. The lighting device of claim 1, wherein the wall has an interior surface and an exterior surface.

4. The lighting device of claim 3, wherein the color pattern is provided on the interior surface.

5. The lighting device of claim 3, wherein the color pattern is provided on the exterior surface.

6. The lighting device of claim 1, wherein the wall includes at least two colors.

7. The lighting device of claim 1, further comprising a cap configured to couple to the diffuser portion of the lighting device.

8. The lighting device of claim 1, further comprising a controller configured to operate the light source.

9. The lighting device of claim 1, wherein the plurality of colors is applied to the diffuser portion by painting.

10. The lighting device of claim 1, wherein the plurality of colors is applied to the diffuser portion by spraying.

11. The lighting device of claim 1, wherein the plurality of colors is applied to the diffuser portion by silk screening.

12. The lighting device of claim 1, wherein the plurality of colors is applied to the diffuser portion by applying a colored film to the diffuser portion to form the color pattern.

13. The lighting device of claim 1, wherein the diffuser portion comprises any of a plurality of shapes.

14. A decorative lamp comprising:

a base portion;

a diffuser portion having a wall defining an inner cavity, wherein a liquid is contained within the inner cavity of the diffuser portion; and a light source supported by the base portion for illuminating the diffuser portion;

wherein the wall includes a plurality of colors, the plurality of colors defining a color pattern configured to create a color-changing effect.

15. The decorative lamp of claim 14, wherein the liquid includes liquid globules.

16. The decorative lamp of claim 14, wherein the wall includes an interior surface and an exterior surface.

17. The decorative lamp of claim 16, wherein the color pattern is provided on the interior surface.

18. The decorative lamp of claim 16, wherein the color pattern is provided on the exterior surface.

19. The decorative lamp of claim 14, wherein the diffuser portion comprises any of a plurality of shapes.

* * * * *